US007034680B2

(12) United States Patent
Grunder

(10) Patent No.: US 7,034,680 B2
(45) **Date of Patent: *Apr. 25, 2006**

(54) ANCHOR/ANCHOR CHAIN MONITORING DEVICE

(75) Inventor: Fritz Grunder, Boll (CH)

(73) Assignee: Deep Blue Technology, AG, Lenzburg (CH)

( * ) Notice: Subject to any disclaimer, the term of this patent is extended or adjusted under 35 U.S.C. 154(b) by 61 days.

This patent is subject to a terminal disclaimer.

(21) Appl. No.: 10/281,769

(22) Filed: Oct. 28, 2002

(65) Prior Publication Data

US 2003/0128138 A1 Jul. 10, 2003

Related U.S. Application Data

(63) Continuation of application No. 09/422,866, filed on Oct. 21, 1999, now Pat. No. 6,472,983.

(30) Foreign Application Priority Data

Apr. 21, 1997 (DE) ..... 197 16 684

(51) Int. Cl.
*G08B 21/00* (2006.01)

(52) U.S. Cl. ..... 340/540; 340/531; 340/539; 73/763

(58) Field of Classification Search ..... 340/540, 340/531, 539, 986, 665, 668, 429, 604; 73/763
See application file for complete search history.

(56) References Cited

U.S. PATENT DOCUMENTS

| | | | | |
|---|---|---|---|---|
| 3,823,395 A | | 7/1974 | Rigney et al. | 340/531 |
| 4,283,707 A | | 8/1981 | Church | 340/442 |
| 4,651,139 A | * | 3/1987 | Oettli | 340/531 |
| 4,912,464 A | * | 3/1990 | Bachman | 340/850 |
| 5,086,651 A | | 2/1992 | Westermo et al. | 73/763 |
| 5,284,452 A | * | 2/1994 | Corona | 441/3 |
| 5,445,103 A | * | 8/1995 | Bleth et al. | 114/293 |
| 5,602,524 A | | 2/1997 | Mock et al. | 340/447 |

FOREIGN PATENT DOCUMENTS

| | | |
|---|---|---|
| DE | 2134104 | 1/1972 |
| DE | 2410528 | 10/1974 |
| DE | G7715093.7 | 9/1977 |
| DE | GM7316102 | 9/1978 |
| DE | 2748922 | 5/1979 |
| DE | 19703141 A1 | 7/1998 |
| EP | 0003685 A2 | 2/1979 |
| EP | 0129833 A1 | 6/1984 |
| EP | 0242115 B1 | 3/1994 |
| GB | 2265468 A | 3/1993 |

* cited by examiner

*Primary Examiner*—Phung T. Nguyen
(74) *Attorney, Agent, or Firm*—James J. Murphy; Stephen S. Mosher

(57) ABSTRACT

A device for monitoring the anchor or anchor chain, intended for facilities floating ahead of the anchor, such as ships, comprising a measurement device which determines by one or more sensors the prevailing state at one or more points of an anchor chain or anchor, between the anchor chain and a ship, or between the anchor and the ship, then generates an electrical signal representative of the strength to a transmitter which, upon reception of the signal transmitted by the measurement device, sends a corresponding signal. An alarm system receives the signal sent by the transmitter and triggers an alarm if the measured state exceeds a set value.

34 Claims, 5 Drawing Sheets

Figure 1:
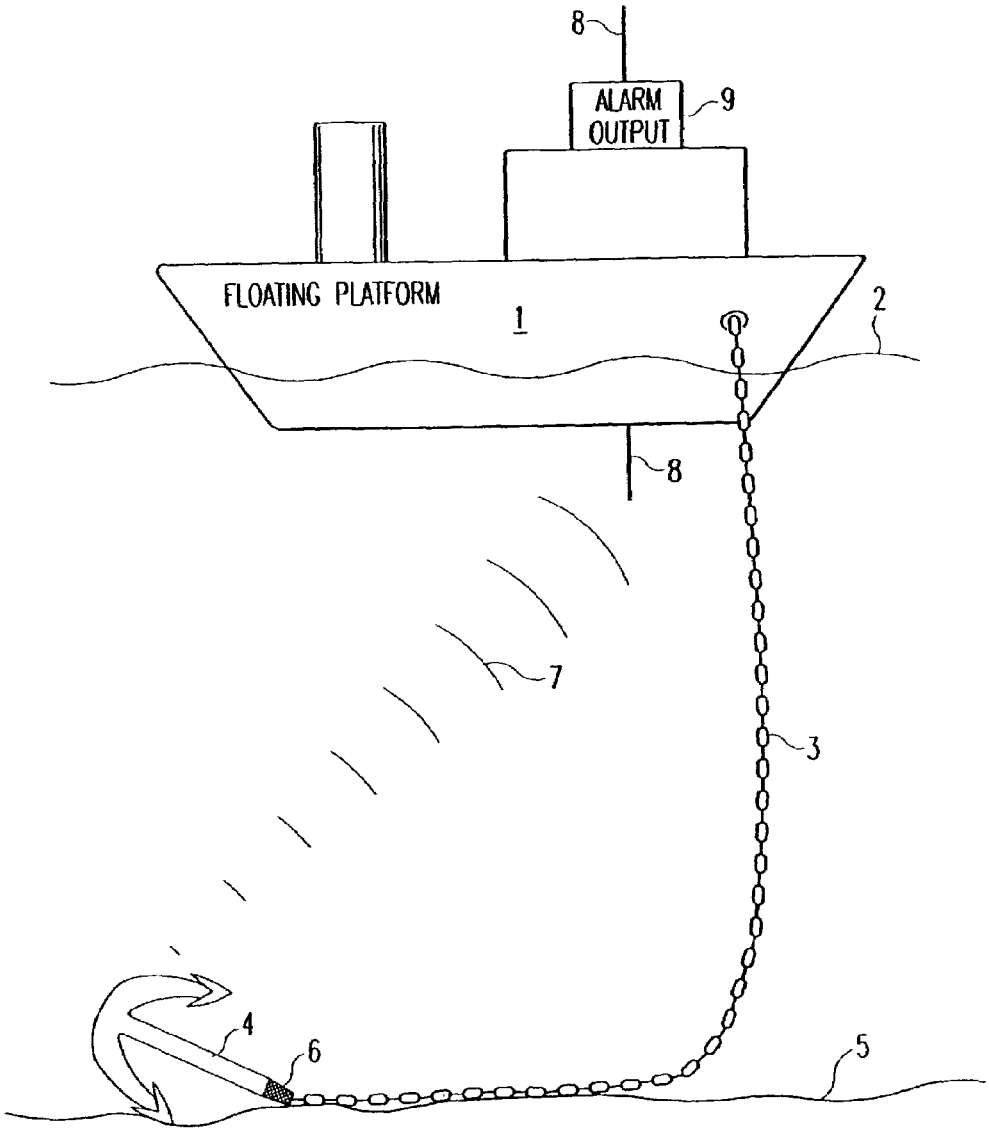

| preamble | identification-signal | data | postamble |
|---|---|---|---|
| 16 BIT | 24 BIT | 32 BIT | 4 BIT |

| preamble | identification-control-signal | identification-signal | postamble |
|---|---|---|---|
| 16 BIT | 24 BIT | 24 BIT | 4 BIT |

ANCHOR/ANCHOR CHAIN MONITORING DEVICE

The present invention relates to an anchor and anchor chain monitoring device for anchored floating objects, in particular ships.

During a ship's voyage, monitoring devices are called into service to determine force acting on a securing mooring apparatus either in a harbor or on a floating buoy apparatus and, whenever necessary, should this force exceed a predetermined value, to trigger an appropriate measure in order to prevent the securing apparatus from renting and the respective floating vessel from then being carried unchecked into the waterway.

A method and a device for monitoring the force acting on a mooring hawser of a single-point mooring device during loading and unloading of a ship is known from DE-AS 21 34 104. According to this known method, the bow of the ship is fastened to the single-point mooring device via the mooring hawser in such a manner that the ship can swing freely and unhindered about the mooring hawser. In this state, the force acting on the mooring hawser is measured and transformed into a signal which is a gauge of the measured force acting on said hawser and which then is transmitted from the single point mooring device onto land or to the ship. The mooring hawser between the ship and the single point mooring device is then released as soon as the transmitted signal displays that force acting on the hawser exceeds a predetermined upper threshold value.

DE-GM-73 16 102 discloses an anchoring apparatus for a floating vessel utilizing a point-anchoring system with a plurality of hawsers. A monitoring means is provided having a monitoring station for receiving and displaying the signals from a plurality of stress meters in order to measure the mechanical stress in the hawser. An interim piece between the hawser securing section and a securing base member is disposed with a stress meter for this purpose.

A dynamic anchoring of ships and similar floating objects is known from DE-OS-2 410 528 in which a propelling means is provided and the ship on the surface of the water is anchored perpendicular to a first fixed point on the sea bed. A buoy, provided with its own dynamic anchoring means, is anchored at a distance from the ship such that no machine or apparatus located either on the ship or on said first sea bed fixed point can interfere with said dynamic anchoring means and the buoy in this manner is able to attain a fixed position with reference to a second point on the sea bed. With help of a measuring device located on the surface, working in concert with a ship's course determining device, the relative position of the ship with respect to buoy and course is determined. Any deviation in position of the ship with respect to the first given sea bed point is corrected by an anchoring means operation respective to delivered error signals of the measuring device.

DE-OS-2 410 528 further describes a buoy encompassing dynamic anchoring means as well as electromagnetic signal transmitter and reflector means.

A method for positioning a watercraft is known from DE-OS-25 02 020 with which a ship is always kept within an outer circle corresponding to the largest permissible inclination of a drilling mud return pipe, a riser, respectively. To this purpose, an anchoring arrangement is employed, as is a plurality of computer-controlled propellers with blades pivotal about a vertical axis. The computer only actuates the propellers after the resultant of the external force acting on the ship or the riser tube angle of inclination exceeds a certain predetermined value.

When values of external force or riser tube angle of inclination remain under the predetermined threshold value, only the compensating by the anchoring arrangement itself serves to keep the ship within a smaller inner circle which has a smaller radius than the radius of the outer circle.

A shear pin for retaining means is known from DE-GM-77 15 093, in particular for mooring arrangements, having sectionally decremental reductions at a measuring point. Stress sensors are arranged in an axle bore of the shear pin; their cavity filled with an sealing compound which hardens subsequent to introduction. The stress sensors are comprised of strain gages which are arranged in pairs at the measuring point and connected via conduits to an electrical circuit.

Cable works with a core are known from DE-OS-27 48 922, in particular for mooring of ships. The core consists of a cable connectable to an indicator system by at least two cable wires. Coexistent its mechanical connection, the cable works also has a clutch which serves for non-contact switching of the cable, whereby one coupling half is arranged at the cable works end and the other half is arranged at a distance thereto. In both coupling halves, moreover, an engageable locking and securing agent is provided. The coupling half disposed at the cable works end has a read contact under its front end at which the cable end is connected; under the front end of the other coupling half, a permanent magnet is disposed which works in concert with the read contact.

A monitoring or alarm system for ship anchor chains is known from GB 2 265 468 A in which a stress sensor controlled by a control means continually measures the tension in an anchor chain. The momentary measured anchor chain tension is compared with a predetermined tension or with the maximum measured tension recorded during the current anchored period, and the control means emits a warning signal when the anchor chain tension is higher than a predetermined critical value. Transmission of the signals between the sensor and the control means can ensue via a cable connection as well as through propagation of electromagnetic waves.

From U.S. Pat. No. 3,823,395, a means for monitoring the payload on cranes and similar contrivances is known. Said means can determine the weight load. A transmitter allocated to the sensor transmits the measured signal to a receiver which in turn shows the signal on a display.

U.S. Pat. No. 4,912,464 discloses an anchor warning device for ships in which a motion detector is arranged on the anchor of a ship and which emits an alarm signal upon significant movement of a sunk anchor.

From U.S. Pat. No. 5,086,651, a device and a method for measuring the mechanical strain in a structural member is known. A material is employed which undergoes a change in phase when strained so that the mechanical strain of a system can be determined through a measurement of the phase change. To effect an even more precise determination, a plurality of elements may be arranged for the monitoring of a complex system, each of said elements formed respectively from one material.

EP-A-0 242 115 defines a method and a system for determining position on a moving platform, for example a ship, utilizing signals from GPS satellites. In this known method, the satellite signals received directly at the moving platform are compared with satellite signals received indirectly through interposing from a base station, thereby determining the momentary position of the moving platform.

The problematic nature of anchors for floating objects will first be described using the example of an anchored ship.

To anchor, a ship lowers an anchor hanging on an anchor chain or hawser onto the waterway bottom so that the anchor, as well as also a large portion of the anchor chain/hawser lies on the sea bottom. What is important here is that the fixation of the ship at a certain area is not effected through the anchor connecting with the sea floor, but rather through the weight imposed on the portion of the anchor chain/hawser lying on the sea floor.

An anchored ship thus can, within a certain given range, move freely about the leverage point of the anchor chain/hawser on the sea bottom biasing the ship, thereby allowing for some give against external forces acting on the ship, as for example the force of currents or winds. As the amount of such external forces acting on the ship increase, this may led to the reaching of a particular condition, dependent upon a value based on weight and the length of the anchor chain/hawser, in which the anchor chain/hawser no longer lies on the sea bed and a force or motion is exerted directly from the ship to the anchor over the anchor chain/hawser. The ship either then drags the anchor unchecked behind itself or, should the anchor be firmly hooked on the waterway bottom, can give rise to the anchor chain breaking or the anchor itself fracturing so that the ship then flounders unchecked and uncontrolled in the waterway and could possibly even run aground.

A situation of this sort is of course extremely dangerous, in particular when the wind direction is towards shore, or when the ship is located in an area having reefs, or when there are other potential shipping channel collision spots in the near vicinity.

Accordingly, it is the task of the present invention to provide an anchor chain, anchor motion and anchor force monitoring device which increases the level of safety for an anchored floating contrivance.

This task is solved in accordance with the present invention by the object of claim 1.

Preferred embodiments constitute the subject matter of the subclaims.

The principle of the present invention consists of recognizing an exceptional condition at a localized position on the anchor chain/hawser, on the anchor itself respectively, so as not to endanger the stability of the anchoring, measuring the force or motion exerted and wirelessly transmitting the measurement.

The device according to the present invention is disposed with a measuring means constituting at least one sensor, which is preferably integrated at the connection between the anchor and chain/hawser, or also at another section of the chain/hawser, or even on the anchor itself, or is mountable on the anchor. It should be emphasized that this type of measuring means can be configured in such a manner that a part of the means is disposed at a section of the anchor or the anchor chain/hawser, meaning under water, and another part of said measuring means is disposed in or on the floating contrivance or ship. It is also possible to allocate a part of the monitoring device independent of the floating contrivance and the anchor device when, for example, the anchoring of a floating contrivance is to be monitored from a ship or from land.

Correspondingly, the alarm device may be disposed on the floating contrivance itself or at another position on another floating object or at a position on land, etc.

Reference to the transition junction is to be understood as not only the point of connection between the anchor and the anchor chain/hawser, but likewise the area adjoining the anchor chain/hawser. What is significant is that the anchor and chain monitoring device should be at least partially disposed in the section which regularly lies on the sea bottom for the purpose of stable anchoring and which essentially renders no large conditional changes.

In a preferred embodiment of the anchor and chain monitoring device according to the present invention, a plurality of sensors are distributed over the anchor chain/hawser so that a localized condition of the anchor device can be determined.

It is also preferable that at least one sensor is either integrated into or disposed on the anchor itself.

The sensor preferably comprises a piezoelectric, resistive, capacitive or inductive sensor element.

The linking of the sensor, respectively the corresponding parts of the measuring means, and the remaining parts of the measuring means, respectively alarm device, can ensue via an electrical cable. In this instance, the cable is arranged parallel to the anchor chain and anchor cable or integrated into the anchor chain and/or anchor cable. This configuration, however, does have the disadvantage that the cable connection may become damaged.

According to a preferred embodiment, the transmission between the measuring means, respectively the parts of the measuring means disposed in the anchor chain/hawser or the anchor, and the parts of the monitoring device situated above water in the floating contrivance, etc., takes place in a wireless fashion, namely through ultrasound, infrared radiation, electromagnetic waves or other suitable wireless transmission methods of propagation.

This method has the fundamental advantage that it excludes the possibility of a cable connection being damaged during lowering and raising of the anchor.

The disadvantage of this configuration however is that interference may arise in circumstances of several floating contrivances being anchored near one another, namely that a ship may receive signals from anchor or anchor chain monitoring devices which actually belong to other vessels.

According to a preferred embodiment of the present invention, it is therefore recommended that when employing wireless transmission, a corresponding identification code be transmitted at the same time which uniquely identifies the transmitting device. Employing an appropriately equipped identification code, for example a digital numeral with a relatively high number of bits, ensures that randomly received signals are not identified as actual measurement results, which otherwise might lead to the triggering of a false alarm.

Instead of an identification made by means of an identification code or a particular identifying pattern, it is also possible to accordingly set the devices at differing frequencies so that the danger of reciprocal interference is reduced.

In a preferred embodiment of the anchor or anchor chain monitoring device according to the present invention, the transmitting means is provided with a control means which induces that the signals are transmitted at intervals, as well as a signal generating means which generates an identification signal which is characteristic for the individual transmission means and which uniquely identifies same, the control means inducing said identification signal to be transmitted at least once during each transmission interval; the alarm output means has a memory in which an identification comparison signal corresponding to each individual transmitting means is stored, as well as a comparison means which analyzes whether the identification signal emitted from the transmitting means concurs with the stored identification comparison signal in the alarm output means; and a forwarding or further processing of the signals received by the alarm output means only occurs when the signals received by the alarm output means and the stored identification comparison signals in the alarm output means are identical.

The anchor or anchor chain monitoring device according to the present invention consists of a transmitting means and a separate alarm output means. This configuration has the advantage that the alarm output means, which is usually directly combined with an actuator, for example a warning light or a siren, can be disposed in the range of vision and/or hearing of the user on board a ship or on land.

The alarm output means may also portably accompany or be worn by the user in any manner. An example hereto would be the user wearing the alarm output means similar to a watch on his wrist.

According to a preferred embodiment, the transmission of the data and identification signal transpires as a digital transmission. This ensures realizing a high data transmission reliability and, as this signal is composed of an accordingly high number of single bits, additionally enables selecting from among a large number of identification patterns.

It is possible at as early a stage as its manufacturing, to delegate a particular transmitting member to a particular alarm output member and vice-versa. However, this would have the disadvantage that, for example upon failure of the alarm output member, the respective transmitting member would likewise be rendered unusable and vice-versa.

According to a preferred embodiment, it is therefore recommended that the allocation between the transmitting member and the alarm output member be configured so as to be variable.

It is preferable in this case that the transmitting member and its respectively utilized alarm output member be employed in an identification signal change mode which enables the alarm output member to record and store the identification signal of its allocated transmitting member. According to a preferred embodiment, this allocation or paired mode comprises several tiers of security in order to prevent an unintentional and erroneous allocation of transmitting member and alarm output member.

The possibility of freely allocating transmitting members and alarm output members has considerable advantages in practical use. Should the alarm output member or the transmitting member fail, only the one defective device has to be replaced, not both. The remaining device can continue in its operation.

This variable allocation has the further advantage that a transmitting device may also be allocated two alarm output devices and vice-versa. It is then possible, for example, that a coastal station can make use of two alarm output devices for the purpose of monitoring the anchored positions of two ships.

Finally, it is also conceivable, particularly with respect to the alarm output means which can be correlated with other functions, that the user can employ disparate equipment models without having to obtain a new transmitting member each time.

In addition, the variable allocation allows for a fundamentally simplified manufacture of the monitoring device.

The identification signal change mode is preferably triggered by a manual actuating of the transmitting means to induce the transmission of a particular signal, the identification control signal, which indicates to the alarm output device that an allocation process should transpire. In order to avoid an unintentional allocation of several alarm output devices to one transmitting device, corresponding security measures can be provided at the alarm output device.

The actual allocation transpires in that, along with the identification control signal, the identification signal of the transmitting member is also emitted. The alarm output device, having been brought into identification signal change mode, receives this identification signal and stores it in the corresponding memory until that point in time when, in the course of a new allocation, a different identification signal is received.

According to a preferred embodiment of the present invention, computing means are installed either in the transmitting device or in the alarm output device.

This allows the anchor or anchor chain monitoring device user to receive an indication of the current condition of both the anchor and the anchor chain/hawser and furthermore, for example, its temporal or localized course of development.

Particularly preferred when employing radio signals is the utilization of signals in the long-wave range, meaning the utilization of radio signals having a frequency from 5 hertz to 100 kilohertz.

Studies have shown that a frequency range of 5 hertz to 50 kilohertz is particularly opportune for transmitting electromagnetic signals under water.

Both the transmitting as well as the alarm output member may be disposed so as to actuate additional functions.

One such additional function is the logging of signals from other sensors. This could be, for example, an entry indicator means constituting mechanical sensors on doors, windows and holds, or a motion sensor for recording movements, especially in a ship's interior, a listing sensor to measure any pronounced tilt of the floating object, or even a flood sensor which indicates when bilge water level has exceeded a predetermined critical value. Furthermore, one or several sensors may be provided which measure the retaining strength of the mooring lines mooring a ship in a harbor. The central alarm means pools these signals and issues a warning alarm when one of the recorded measurements reaches a critical condition. This is usually the case when a predetermined critical threshold value of force or motion is exceeded.

When using sensors on mooring lines, a critical condition can also be reached when several mooring lines are used and none of these lines indicates a signal of force.

In the case of an alarm means which encompasses sensor signals only in connection with an anchor, as well as in the case of a central signal means which logs several sensors in the manner as described above, the warning signal can also be sent in a wireless transmission to the receiving device, for example which is carried by an onshore user. The user is then automatically informed about the critical condition of his ship.

The wireless transmission may transpire with the radio transmission technologies known for the radio range released for these frequencies. It may also be alternatively provided that the central alarm means is dialed up via a suitable modem of a portable telephone, for example a mobile telephone according to the GSM standard.

In all the foregoing wireless transmission methods mentioned, messages from a central alarms means to a remotely situated user can be transmitted acoustically or as an alphanumerical signal. In the former method, for example, after establishing a connection, per telephone for instance, text stored in the alarm means is played back acoustically such as, for example, the phrase "water on board." Or this text could be shown visually on the receiver's display. It should be pointed out that the above-mentioned central device may also then be employed when no anchor chain monitoring device is activated, for example when the ship is just moored with lines in the harbor, or when just a line monitoring device is provided.

The invention furthermore provides a sensor for anchor chain monitoring which is not only especially opportune for use in the anchor chain monitoring device as described herewithin, but which can also be employed in monitoring devices having other characteristics than as described in claim 1. Said anchor chain sensor consists of an essentially cylindrical ring made of a piezoelectrically acting ceramic connected on both sides to metal disks which have an outer diameter corresponding to the outer diameter of the piezoelectric rings.

The metal disks are reciprocally linked to the anchor chain and/or the anchor such that a tension acting on the anchor chain and/or the anchor leads to a compressing of the ring.

The entire sensor is wholly cast into a waterproof sealing compound of plastic or similar material. Furthermore, the transmitter is also preferably affixed to one of said metal disks and is likewise situated within the protective sealing compound.

By means of such a device, a very strong signal can be generated when the corresponding stress is determined on the anchor cable, the sensor respectively.

In this configuration, the transmitting means remains in a stand-by mode during normal operation, using only very little energy. As soon as stress is effected on the sensor, a signal is generated by the piezo ring and fed to the transmitting means. This signal is what induces the transmitting means to switch to an actual operational mode.

This embodiment encompasses two possibilities for operational mode.

In the first possibility, the stand-by mode and the operational mode are coordinated such that switching to the operational mode only occurs when the signal registers above a control value signifying a critical load. In this embodiment, a warning signal is therefore emitted directly after switching from stand-by mode to operational mode. Or, to put it another way, as soon as a jerk which exceeds a predetermined measure is exerted on the anchor, the anchor chain respectively, the transmitter switches on and an alarm is triggered.

In a second embodiment, upon exceeding of a predetermined force on a sensor, a monitoring device provided with such a sensor is merely induced to switch from stand-by mode to operational mode. Then the device, in operational mode, takes a measurement of the force as previously described and as soon as the force exceeds a predetermined threshold, triggers an alarm.

Figure 2:
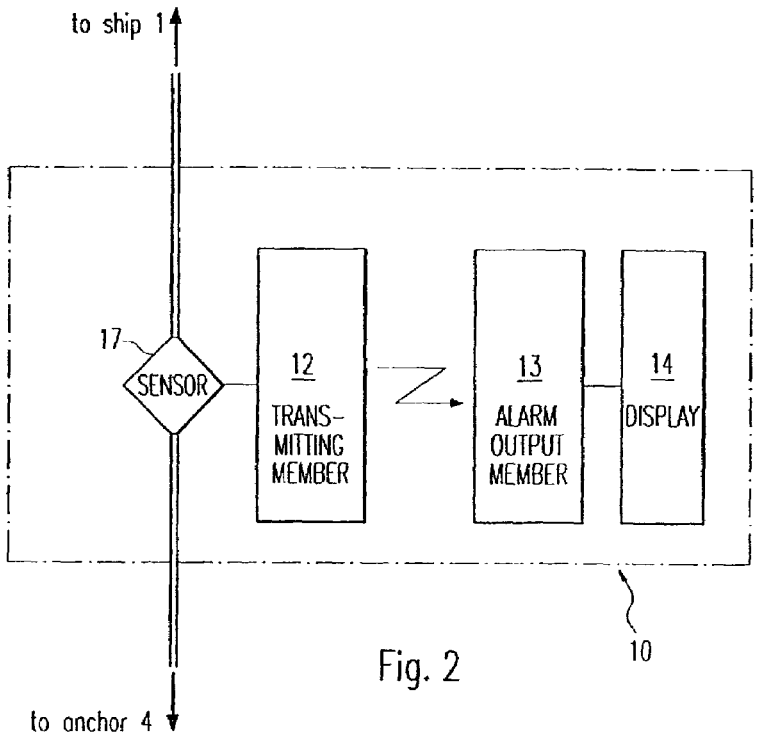
Figure 3:
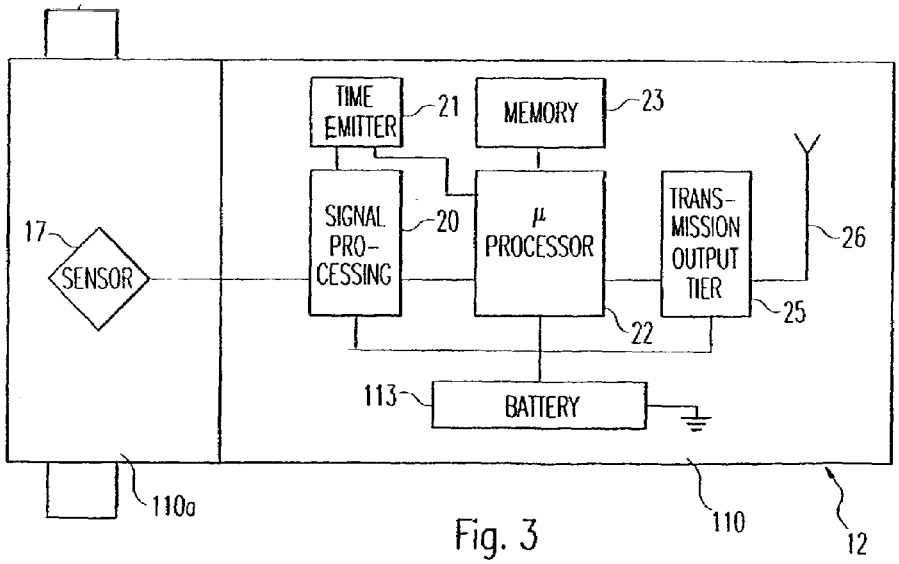
Figures 4, 5, 6:
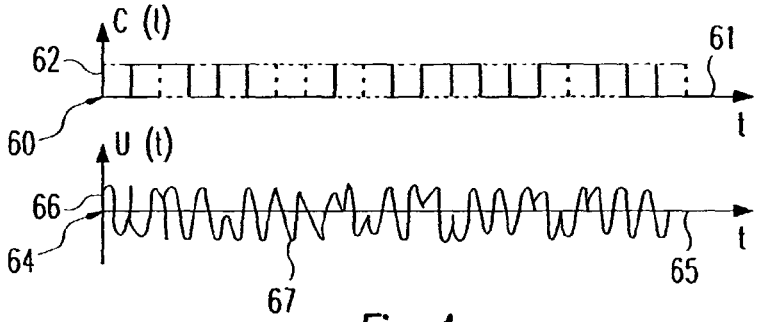
Figure 7:
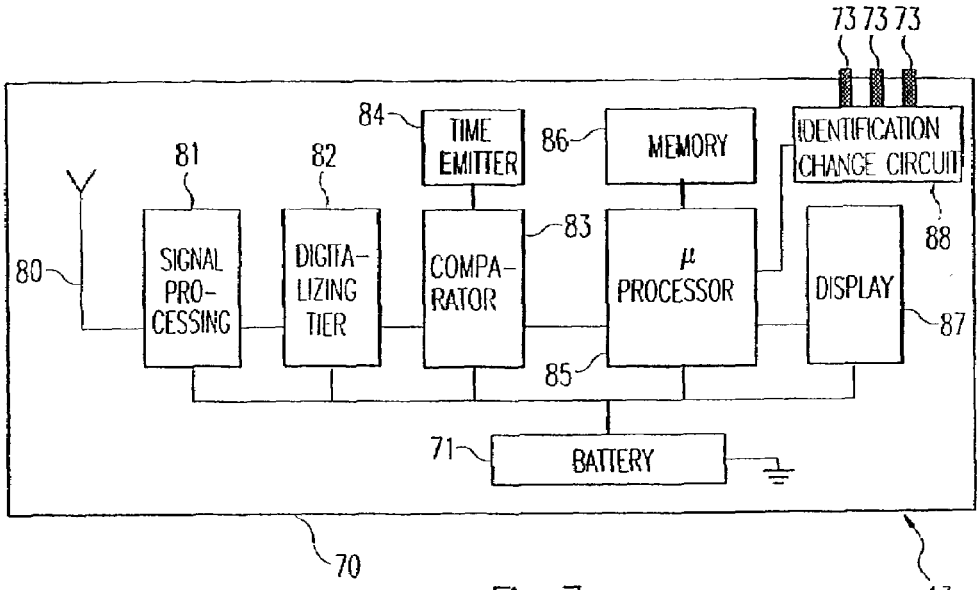
Figure 8:
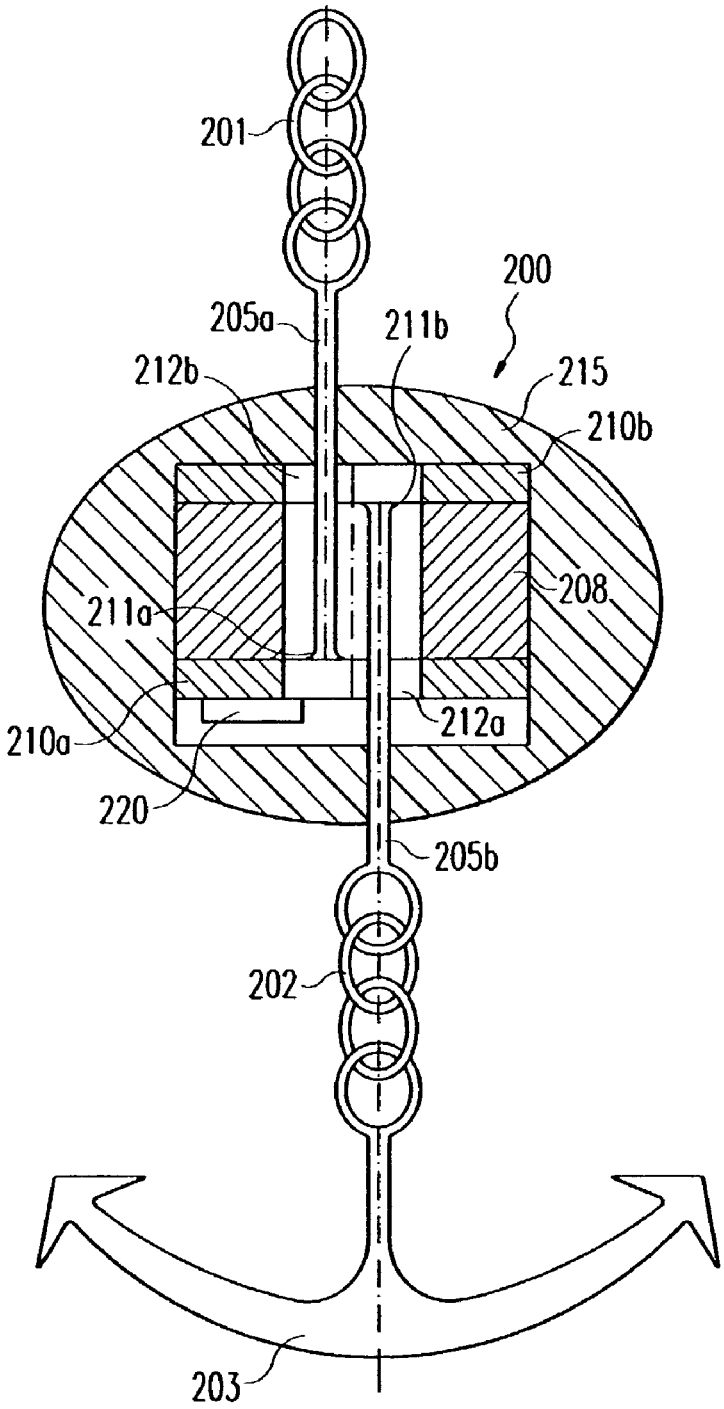

Preferred embodiments of the present invention will now be described with reference to the accompanying drawings, which show:

FIG. 1 a schematic representation of an anchor or anchor chain monitoring device according to the present invention;

FIG. 2 a schematic representation of function of an anchor or anchor chain monitoring device according to the present invention;

FIG. 3 a schematic representation of the coding of the transmission signal of the embodiment according to FIG. 2;

FIG. 4 a schematic representation of the configuration of the transmission signal during normal operation in the embodiment according to FIG. 2;

FIG. 5 a schematic representation of the configuration of the transmission signal during identification change mode in the embodiment according to FIG. 2;

FIG. 6 a schematic representation of the alarm output member of the embodiment according to FIG. 2;

FIG. 7 circuit diagram of an anchor or anchor chain monitoring device according to the present invention;

FIG. 8 a partial sectional view of a basic representation of an embodiment of a sensor for the registering of force acting on the anchor or anchor chain.

Identical reference numerals in the figures refer to the same or corresponding components.

The embodiments of an anchor or anchor chain monitoring device according to the present invention are described in detail in the following with regard to their employment with an anchor chain/hawser and an anchor for a ship.

Said embodiments however, with the appropriate modifications, could also be applied as required in anchor chains for drilling rigs, floating docks and such similar objects.

FIG. 1 shows a schematic representation of an anchor or anchor chain monitoring device according to the present invention.

In FIG. 1, the reference numeral 1 depicts a ship situated in a shipping channel 2. The ship 1 is provided with an anchor chain or hawser 3. One end of said chain or hawser 3 is lowered by means of an anchor cable winch (not shown), and its other end is affixed to an anchor 4. In this figure as shown, the anchor chain or hawser 3 is fully uncoiled from the (not shown) anchor winch and lies partially on the sea bed 5 together with anchor 4.

According to the present invention, an anchor or anchor chain monitoring device is provided comprised of, for example, member 6 located at the junction transition area between anchor 4 and anchor chain/hawser 3 and member 8,9 located on board the ship.

It should be noted that said member 8,9 may also be located in a coastal station.

Said member 6 located in the transition area between anchor 4 and anchor chain/hawser 3 is provided with a measuring means for registering the changes in condition between anchor 4 and anchor chain/hawser 3 by means of one or more sensors and which emits an electrical signal representative of the force or movement.

A transmitting means in concert with the measuring means is further provided in member 6 which receives the signal emitted from said measuring means and transmits a corresponding transmission signal, for example a radio signal, as is depicted by reference numeral 7 in FIG. 1.

Said member 8,9 located on board ship 1 comprises an alarm output means 9, provided in the depicted example with an antenna 8, which receives the transmission signal emitted from the transmitting means. Further provided on board the ship is a (not shown) operations/display means linked to the alarm output means 9 for displaying the data as numerals or symbols which are derived at least partially from the transmission signal 7 received from said receiving means 9, whereby said data reveals, for example, the temporal or localized condition of the sensor or sensors.

In the following, the operation of an anchor or anchor chain monitoring device configured in accordance with the present invention will be described in further detail.

The transmitting means has a control means which induces that the transmission signals are transmitted in intervals. Furthermore, a signal generating means is provided in the transmitting means which generates an identification signal which is characteristic of the individual transmitting means and which uniquely identifies same, whereby the control means induces that said identification signal is transmitted at least once within each transmission interval.

Correspondingly, a memory is provided in alarm output means 9 in which the corresponding identification comparison signal allocated to the individual transmitting means is stored. The alarm output means is provided with a comparison means which analyzes whether the identification signal emitted from said transmitting means concurs with the identification comparison signal stored in the alarm output means and permits a forwarding, respectively further processing, of the alarm output means' received signals only when the received identification comparison signals and the identification comparison signals stored in the alarm output means are identical.

Thus, a unique allocation can be made of the transmitting means on board the ship 1 or at the transitional area between anchor 4 and anchor chain/hawser 3, on the basis of signals received.

Should the prevailing force or movement between anchor 4 and anchor chain/hawser 3 increase in the region of member 6, a warning signal is triggered in member 8,9, which is preferably located on board the ship, which indicates that the ship is about to succumb to an uncontrollable condition, so that the ship's personnel can undertake the appropriate countermeasures.

The alarm means is preferably so configured that a signal is triggered when a predetermined value of force or motion is exceeded, whereby the threshold here is dependent upon the design of the anchor, the allocation of the measuring sensor or sensors on the anchor in the area between the anchor and anchor chain or on the anchor chain itself, as well as upon other factors such as the size of the ship, etc.

In order to prevent a situation in which the failure of the means would result in an unnoticed cessation of alarm signal transmission, same should preferably be analyzed at regular intervals and a warning signal should issue if the connection between the alarm means and the measuring means, measuring sensors respectively, is interrupted or ceases.

Said warning signal can be an acoustical or a visual warning signal and can automatically introduce a corresponding countermeasure such as, for example, starting the motors or automatically setting the course.

It should be noted that in the anchor/anchor chain monitoring device according to the present invention the positioning of member 6 with the measuring means between anchor 4 or on anchor and anchor chain/hawser 3 is not to transpire at the precise junction transition point between anchor 4 and anchor chain/hawser. Rather, the positioning of the member is at a predetermined location at which a predetermined force or motion should not be exceeded. Even a plurality of respective members 6 may be distributed over the locality of anchor chain/hawser 3 in order to enable that the force/motion acting on anchor chain/hawser 3 induces a locality-contingent triggering of transmission to member 8,9.

FIG. 2 depicts a schematic representation of function of the anchor/anchor chain monitoring device, which as a whole is identified with the reference numeral 10, and having a transmitting member 12 comprising the transmitting means and an alarm output member 13 comprising the alarm output means.

Said transmitting member 12 and a sensor 17 arranged in the transition area between anchor 4 and anchor chain/hawser 3 are disposed underwater, whereby sensor 17 measures the force or motion acting between anchor 4 and anchor chain 3.

The sensor may be of any type as, for example, a piezoelectric, resistive, capacitive, inductive or any such similar type of sensor.

The alarm output member 13 is arranged on board the ship at a spatial spacing from transmitting member 12 and is coupled with a display means 14, normally integrated directly in the housing of the alarm output member 13 or in the operating member.

FIG. 3 depicts a schematic representation of the transmitting member of the embodiment according to FIG. 2.

Said transmitting member 12 schematically represented in FIG. 3 is provided in a housing 110 composed of a non-magnetic material, preferably plastic, and which encompasses its electrical and electronic elements. The interior of the transmission member 12 housing 110 is completely filled with electrically non-conductive oil, silicon or similar substance. The part 110*a* of the housing 110 in which sensor 17, or a plurality of sensors is arranged, is configured such that it will be subjected to the force acting on anchor 4 or anchor chain/hawser 3 during use. The remaining portion of housing 110 is likewise sealed in order to prevent an ingress of water.

Furthermore, a battery 113 or other energy source is also provided within housing 110 for supplying electrical power to transmitting member 12 and which is thereby likewise subjected to the force on housing 110.

The configuration of the electrical components of said transmitting member 12 will be described in detail in the following with reference to FIG. 3.

Sensor 17 is connected via an electrical conduit (here and in the following always represented only in schematic), to a signal processing circuit 20. All types of sensors as customarily known in the trade may be utilized provided that said sensor may be operated at a low voltage and consumes as little energy as possible. Therefore, especially preferred sensors are those which function in accordance with the piezoelectrical principle.

An A/D (analog-to-digital) transformer in signal processing circuit 20 converts the analog signal of sensor 17 into a digital signal. Said signal processing circuit 20 is furthermore connected with a quartz-controlled time emitter 21, the function thereof to be described in the following. The digitally processed signal is fed to a conventional microprocessor computing unit 22. The microprocessor computing unit 22 is linked to a memory 23 and likewise receives the signals from time emitter 21. Memory 23 (and the corresponding memory in alarm output member 13 or the operating member) may be wholly configured from RAM memory elements. It is also possible, however, to employ a mixed memory consisting of ROM (constant memory) and RAM (random access memory) elements. Since a stable continuous voltage is provided, the contents of memory are saved long-term even when working with volatile memory elements.

Microprocessor 22 converts the signal as well as the other signals to be transmitted into a transmission signal according to a program saved in memory 23 and feeds same to a transmission output tier 25. The signal is transmitted from transmission output tier 25 to, for example, antenna 26.

Transmitter 26 consists of a ferrite core which is wrapped in copper wire. An especially favorably range of inductance for the transformer coil has been confirmed to lie between 10 and 50 megahertz.

The interval of time transpiring between the measurement of condition and the transmission of signal is not constant, but rather varied by the microprocessor in accordance with a computing procedure during a pre-determined time domain. However, the signal transmission always transpires before the receipt of the next measurement. This temporal variation has the advantage that in the instance of two anchor or anchor chain monitoring devices being operated simultaneously to monitor different anchor or anchor chains situated at only a short distance apart from one another, transmitted signal values will only collide randomly. If the interval of time between the measurement of condition and the transmission of signal was always the same, unfavorable constellations could arise in which the values emitted from two transmitting members would collide with one another over a longer period of time.

Signal transmission from transmitting means 12 to alarm output means 13 transpires, for example, by means of an electromagnetic radio wave of constant frequency. The quartz-controlled time emitter 21 serves to control the transmission frequency. Since the frequency of the oscillating quartz amounts to 32,768 Hz, the structuring of the transmission member is simplified when a frequency is employed which derives from this frequency correlated with a divider of $2^n$. Hereby the frequencies of 32,768 (n=0), 16,384 (n=1), 8,192 (n=2) and 4,096 (n=3) are particularly preferred. Trials have shown that an especially good underwater data transmission is achieved with the utilization of a carrier frequency of 8,192 Hz.

In the interest of high noise immunity in a data transmission, the data signals to be transmitted are digitally coded in transmitting member 12. There are various methods known in the prior art for transmitting digital values in which the carrier signal frequency, amplitude or phasing can be modified.

A known method, which can also be utilized with the anchor or anchor chain monitoring device of a type depicted here, is the changing of the transmission signal frequency employing the so-called "frequency shift keying" process. In this process, the bit information contents 0 and 1 are allocated different frequencies which, however, means two frequencies must be transmitted, increasing the efforts expended at both transmission and receiving ends.

The best transmission prospect has proven to result from a manipulation of the phasing utilizing the so-called "phase shift keying" (PSK) process. In the present embodiment, a further specific variation of the PSK procedure is employed, namely a differential phase shift keying" (DPSK).

In this procedure, the transmission signal experiences a phase jump when a "1" is ascertained: should a "0" be transmitted, the transmission signal remains unchanged. As the first bit of the transmitted bit pattern in this method contains an uncertainty, it cannot serve as an information carrier.

An example or this digital encoding is represented in FIG. 4. Diagram 60 depicts a bit pattern constituting the bits 011010011 . . . , across a time axis 61 and a numerical axis 63.

In diagram 64, a voltage signal 67 is plotted over the same scaled time axis 65 and a voltage axis 66 which has a constant frequency, however in which the bit pattern is cast as the phase change through the afore-described DPSK modulation.

Within each transmission interval, a signal sequence is transmitted which, as is shown in FIG. 6, constitutes a preamble, the identification signal, a data block and a postamble. The preamble serves to enable the alarm output means the synchronization of the transmitted signal. The identification code contains the transmission-specific identifier. The actual data block to be transmitted is at the identification code. In each instance, the data block contains the measured force value, but may also, in a further embodiment, contain additional sensor values which are acquired by the corresponding additional sensors (not shown). Naturally additional data can also be transmitted according to desire or need in further specific applications. The postamble is thereto attached, to serve for fault recognition and correction, etc.

In the embodiment shown, the synchronization interval comprises 16 bits, the identification code 24 bits, the data block 32 bits and the postamble 4 bits. Each signal is therefore 76 bits long.

Trials have shown that it is favorable for the DPSK as employed to have a total of 8 cycles of carrier frequency per bit emitted at 8,196 Hz. This results in a total transmission time of 0.976 ms/bit or a total signal duration of approximately 74 ms.

The configuration of alarm output member 13 will now be described with reference to FIG. 7. The alarm output member 13 is arranged together with an energy supply and separate from transmitting member 12 in a plastic housing 70. Said alarm output member 13 has no physical connection whatsoever, neither via mechanical means nor electrical conduit, to transmitting member 12.

In order to switch the device into operational mode and to confirm the allocation in pairing mode, switch 73 is recessed into the housing to be operated by the user.

Alarm output member 13 has one or two ferrite antennas or other transceivers 80, as shown schematically in FIG. 7. The received signal is first fed to a signal processing and amplifying tier 81, to which a digitalizing tier 82 is connected. Both components correspond to conventional design.

The digital signal is fed to a comparator 83. Said comparator 83 ascertains whether the received and processed signal contains the identification signal or the identification control signal. Should this be the case, the signal is then fed to a microprocessor 85 which, controlled by a program stored in memory 86, takes over the further processing.

The utilization of the upstream comparison tier 83 has the advantage that the microprocessor 85 is only fed the signal after it has first been established that the individual alarm output means has been addressed.

The time control of the alarm output member transpires via time emitter 84.

The evaluated data from the received signal as well as any other desired necessary data is shown to the user on display 87. Display 87 is arranged behind a transparent section of the wall of housing 70 of alarm output member 13. Display 87 shows the prevailing condition of force or motion on the anchor or between the anchor 4 and the anchor chain/hawser 3 as well as preferably the temporal and/or localized course of development of same.

The respective data remains visible on display 87 until after the next measurement and transmission of new ascertained data values.

The alarm output means further has a circuit means 88 (shown here only in schematic representation) disposed with said previously mentioned switches 73. Switches 73 may also be arranged at large distances from one another or even on disparate sides of housing 70.

The actual process of allocation or the pairing of transmitting member 12 and alarm output member 13 during the identification signal change mode will now be described in the following.

As already indicated, each transmitting member is allocated a unique identification signal during manufacture, one which is only commissioned once. In the embodiment described above, a 24 bit signal is utilized, which results in a total of 16.7 million different identification possibilities.

This high number ensures that basically no two transmitting members will ever have the same signal.

The identification signal of transmitting member 12 is stored in a constant memory region of memory 23 of said transmitting member 12. It is also possible to store the identification signal in a RAM memory area, but in this case the signal must also be otherwise identifiable in the device, for example, by a simultaneous utilization of its manufacturing number so that, for example subsequent to exchanging of the battery, the signal can be correctly re-interpolated again.

The identification signal change mode is started when said transmitting member 12 is, for example, restarted subsequent to a battery change. Transmitting member 12 then migrates to identification change mode and transmits, as represented in FIG. 6, a signal comprised of a preamble, an identification control signal, the actual identification signal and a postamble. In the embodiment shown, the preamble comprises 16 bits, the postamble 4 bits, and both the identification control signal as well as the identification signal are 24 bits.

The identification control signal is recognized by all alarm output members of the corresponding series. As soon as an alarm output member 13 receives said signal, the microprocessor induces a switching over to identification change mode. Via display 87, the processor then prompts whether the identification signal of said transmitting member should be queried. When the user confirms this in the circuit means 88 via switch 73, the identification signal of transmitting member 12 will be appropriated and stored as the identification comparison signal in memory 86.

In order to prevent an inadvertent allocation of devices, the identification change mode of the embodiment is provided with several tiers of security.

A first security tier constitutes the alarm output member 13 executing an energy measurement of the signals received in identification change mode with the corresponding means. The receiving member program is configured such that when the identification control signal is received, an energy measurement of the entire total signal is always executed. An allocation is only possible when the transmitted energy exceeds a predetermined threshold.

Transmission of energy from transmitting member to alarm output member is, as is already known, dependent upon the distance, and to a considerable extent also the respective alignment, of both antennas or of sensor and receiver to one another. Only when the devices are arranged in a particular manner spatially from and with respect to their angularity to one another, is the energy received by alarm output member 13 at its maximum highest. The energy measurement critical value is therefore selected such that an allocation may only transpire when transmitting and alarm output members 12, 13 are arranged at a predetermined distance from one another and in addition are at a predetermined angular alignment with respect to each other. In order to simplify the arrangement with respect to angularity, the antennas or sensor and receiver of transmitting member 12 and alarm output member 13 are preferably selectably arranged on the respective housing such that maximum energy results from a parallel or T-shaped arrangement of the devices from one another.

In order to exclude fortuity here as well, the transmission of the identification control signal is repeated several times, but does not proceed to emit at sufficient signal energy until the measured value of a specific percentile share of the transmission registers above the critical value.

Finally, and this constitutes the next tier of security, the user is required to activate circuit device 88 in order to confirm the identification change. This requires, for example, that said three switches 73 must be correlated in such a manner that only two can be activated during identification change mode.

An allocation will not transpire until all the contingencies associated with the various tiers of security have been met.

An embodiment of a sensor means for measuring the force acting on the anchor chain will be described in the following with reference to FIG. 8, whereby such a sensor may alternatively be arranged at other positions on a ship or similar contrivances, for example on a mooring line or between a mooring line and its corresponding connective component such as, for example, a bollard.

The sensor means, identified as a whole by reference numeral 200, is arranged between a first section 201 of an anchor chain and a second section 202 of said anchor chain, whereby said second section 202 of said anchor chain is joined to anchor 203.

A cylindrical shaft 205*a*,205*b*, which is a part of the sensor device, is provided on both chain sections 201,202 respectively.

The sensor itself is a cylindrical ring 208 of piezoelectric material on which cylindrical metal disks 210*b* and 210*a* are disposed.

Cylindrical disk 210*b* is joined to chain section 205*b* by means of a welded seam and led through drill hole 212*a* on cylindrical disk 210*a*.

Correspondingly, chain section 205*a* is joined to cylindrical ring 210*a* by means of a welded seam and led through drill hole 212*b*.

The entire sensor itself is cast into a flexible mass 215 comprised of an electrically non-conductive plastic, tar or asphalt-like, or similar substance.

Transmitter member 220 is arranged on ring 210*a* and which corresponds essentially to the transmitter member as described with reference to FIG. 3.

The function of this sensor means is as follows:

When tension forces act on cylindrical shafts 205*a*, 205*b*, a pressure load is effected between metal disks 210*a* and 210*b* which compresses sensor 208. Due to the piezoelectric properties of sensor 208, an electrical signal is then emitted which is received by transmitter member 220. The signal is processed by said transmitter member 220, resulting in switching said member from stand-by mode to operational mode.

According to the actual configuration of the transmitting member, a warning signal is either triggered directly upon switching from stand-by mode to operational mode, or additional measurements are first taken and a warning signal issues thereafter only when the measured force value exceeds a predetermined threshold.

The invention claimed is:

1. An anchor or anchor chain monitoring device for anchored floating objects, and in particular ships, having:

a measuring means for measuring at least one tension force condition occurring on at least one position of an anchor chain/hawser between said anchor and said floating object, the measuring means employing at least one sensor to record the at least one condition and emitting an electrical signal characteristic of said condition or conditions, said sensor being positioned between said anchor and said floating object and in contact with said anchor chain/hawser;

transmitting means which receives said signal emitted from said measuring means and which transmits a signal corresponding thereto; and an alarm output and operating means which receives said signals emitted by said transmitting means and issues a warning alarm when the measured condition(s) exceed a predetermined critical value.

2. Anchor/anchor chain monitoring device according to claim 1, characterized in that said alarm output means is disposed with a display means for displaying said measured values of force.

3. Anchor or anchor chain monitoring device according to claim 1 or 2, characterized in that a sensor is disposed in the junction transition section between said anchor and anchor chain/hawser.

4. Anchor or anchor chain monitoring device according to claim 3, further characterized in that said alarm output means has a microprocessor unit controlled by a program stored in a memory allocated to said alarm output means.

5. Anchor or anchor chain monitoring device according to claim 1, further characterized in that the transmission of the values between sensor, measuring means and alarm output means transpires via a cable connection.

6. Anchor or anchor chain monitoring device according to claim 5, further characterized in that at least one of the transmission paths between sensor, measuring means and alarm output means utilizes a wireless data transmission.

7. Anchor or anchor chain monitoring device according to claim 1, further characterized in that a transformer is provided which digitally converts the signals to be transmitted by said transmitting means.

8. Anchor or anchor chain monitoring device according to claim 1, further characterized in that said transmitting means includes at least control means and signal generating means pooled in a first microprocessor means which is controlled by a program stored in a memory.

9. Anchor or anchor chain monitoring device according to claim 1, further characterized in that an identification signal for said transmitting means is stored as a digital numerical sequence of n-bits and that said receiver identification comparison signal is likewise stored as a digital numerical sequence of n-bits.

10. Anchor or anchor chain monitoring device according to claim 9, further characterized in that said identification signal stored in said transmitting means and/or said identification comparison signal stored in said alarm output means is/are variable, and said identification signal and/or said identification comparison signal of said transmitting and/or alarm output means match each other.

11. Anchor or anchor chain monitoring device according to claim 10, characterized in that said signal generating means of said transmitting means generates an identification control signal which is stored in said memory of said alarm output means as an identification control comparison signal, and that said comparison means switches said alarm output means into an identification signal change mode as soon as said comparison means recognizes that one of the identification control signals emitted from said transmission means is identical with said identification control comparison signal stored in said alarm output means.

12. Anchor or anchor chain monitoring device according to claim 11, characterized in that said transmitting means has a first detector means which recognizes occurrence of a predetermined condition and induces a switching of said transmitting means from a transmitting mode in which at least condition and identification signal are emitted, into a identification signal change mode in which an identification control signal and said identification signal are emitted.

13. Anchor or anchor chain monitoring device according to claim 11 or 12, characterized in that said alarm output means has a receiver energy measuring means which measures the energy of the signals received from said transmitting means at least when said comparison means determines that one of said identification control signals emitted from said transmitting means is identical with said identification control comparison signal stored in said alarm output means.

14. Anchor or anchor chain monitoring device according to claim 1 further characterized in that the force acting on said anchor chain or said anchor is measured via a piezoelectric force sensor which is arranged between two pressure disks, whereby each of said pressure disks is connected with a tension-introducing member linked to said anchor chain or anchor portion and arranged on said pressure disks' far side to said piezoelectric sensor.

15. Anchor or anchor chain monitoring device according to claim 14, characterized in that said piezoelectric sensor is of essentially cylindrical ring shape and that said pressure disks are essentially contrived as flat cylindrical rings.

16. Anchor or anchor chain monitoring device according to claim 14, characterized in that said tension-introducing element is arranged within the inner drill hole of said cylindrical rings.

17. The device according to claim 1, characterized said sensor is positioned within an housing within which further a battery pack is provided for supplying electrical power to said transmitting means.

18. The device according to claim 1 wherein the at least one condition is selected from the group consisting of force and motion.

19. Anchor or anchor chain monitoring device for anchored floating objects, and in particular ships, having:

a measuring means for measuring at least one tension force condition occurring in at least one position of an anchor chain/hawser between said anchor and said floating object, and which employs at least one sensor to record said at least one condition and which emits an electrical signal characteristic of said at least one condition, with said sensor being positioned between adjacent chain links of said anchor chain between said anchor and said floating object;

transmitting means which receives said signal emitted from said measuring means and which transmits a signal corresponding thereto; and an alarm output and operating means remote from said anchor which receives said signals emitted by said transmitting means and issues a warning alarm when the measured condition(s) exceed a predetermined critical value.

20. Anchor/anchor chain monitoring device according to claim 19, characterized in that said alarm output means is disposed with a display means for displaying said measured values of force.

21. Anchor or anchor chain monitoring device according to claim 19 or 20, characterized in that the transmission of the values between sensor, measuring means and alarm output means transpires via a cable connection.

22. Anchor or anchor chain monitoring device according to claim 19 or 20, characterized in that at least one of the transmission paths between sensor, measuring means and alarm output means utilizes a wireless data transmission.

23. Anchor or anchor chain monitoring device according to claim 20, further characterized in that said alarm output means has a microprocessor unit controlled by a program stored in a memory allocated to said alarm output means.

24. Anchor or anchor chain monitoring device according to claim 19, characterized in that a transformer is provided which digitally converts the signals to be transmitted by said transmitting means.

25. Anchor or anchor chain monitoring device according to claim 19, characterized in that said transmitting means includes at least control means and signal generating means pooled in a first microprocessor means which is controlled by a program stored in a memory.

26. Anchor or anchor chain monitoring device according to claim 19, further characterized in that an identification signal for said transmitting means is stored as a digital numerical sequence of n-bits and that said receiver identification comparison signal is likewise stored as a digital numerical sequence of n-bits.

27. Anchor or anchor chain monitoring device according to claim 26, further characterized in that said identification signal stored in said transmitting means and/or said identification comparison signal stored in said alarm output means is/are variable, and said identification signal and/or said identification comparison signal of said transmitting and/or alarm output means match each other.

28. Anchor or anchor chain monitoring device according to claim 27, characterized in that said signal generating means of said transmitting means generates an identification control signal which is stored in said memory of said alarm output means as an identification control comparison signal, and that said comparison means switches said alarm output means into an identification signal change mode as soon as said comparison means recognizes that one of the identification control signals emitted from said transmission means is identical with said identification control comparison signal stored in said alarm output means.

29. Anchor or anchor chain monitoring device according to claim 28, characterized in that said transmitting means has a first detector means which recognizes occurrence of a predetermined condition and induces a switching of said transmitting means from a transmitting mode in which at least condition and identification signal are emitted, into a identification signal change mode in which an identification control signal and said identification signal are emitted.

30. Anchor or anchor chain monitoring device according to claim 28 or 29, characterized in that said alarm output means has a receiver energy measuring means which measures the energy of the signals received from said transmitting means at least when said comparison means determines that one of said identification control signals emitted from said transmitting means is identical with said identification control comparison signal stored in said alarm output means.

31. Anchor or anchor chain monitoring device according to claim 19, further characterized in that the force acting on said anchor chain or said anchor is measured via a piezoelectric force sensor which is arranged between two pressure disks, whereby each of said pressure disks is connected with a tension-introducing member linked to said anchor chain or anchor portion and arranged on said pressure disks' far side to said piezoelectric sensor.

32. Anchor or anchor chain monitoring device according to claim 31, characterized in that said piezoelectric sensor is of essentially cylindrical ring shape and that said pressure disks are essentially contrived as flat cylindrical rings.

33. Anchor or anchor chain monitoring device according to claim 31, characterized in that said tension-introducing element is arranged within the inner drill hole of said cylindrical rings.

34. Device according to claim 19, characterized said sensor is positioned within an housing within which further a battery pack is provided for supplying electrical power to said transmitting means.

* * * * *